US006805069B2

(12) United States Patent
Thompson

(10) Patent No.: US 6,805,069 B2
(45) Date of Patent: Oct. 19, 2004

(54) FINGER PINCH GUARD FOR HANDRAILS

(76) Inventor: David M. Thompson, 802 Mantoloking Rd., Bricktown, NJ (US) 08723

( * ) Notice: Subject to any disclaimer, the term of this patent is extended or adjusted under 35 U.S.C. 154(b) by 0 days.

(21) Appl. No.: 10/359,371

(22) Filed: Feb. 6, 2003

(65) Prior Publication Data

US 2004/0154522 A1 Aug. 12, 2004

(51) Int. Cl.[7] ..... B63D 17/00
(52) U.S. Cl. ..... 114/343; 114/364
(58) Field of Search ..... 114/343, 364

(56) References Cited

U.S. PATENT DOCUMENTS 3,439,644 A * 4/1969 Pennington ..... 114/210
5,197,926 A * 3/1993 Cunard ..... 472/118
6,443,088 B1 * 9/2002 Putman et al. ..... 114/343

FOREIGN PATENT DOCUMENTS

JP 2003-52764 * 2/2003

* cited by examiner

*Primary Examiner*—Sherman Basinger
(74) *Attorney, Agent, or Firm*—Andrew W. Ludy

(57) ABSTRACT

A finger pinch guard is used in connection with railings on a boat. Stanchions of adjacent railing segments are mounted close together on the boat gunwales. Each pair of adjacent railings forms a generally Y shaped profile in an arcuate transition area wherein fingers can jam. A mounting member having an axle is attached to the railing in this area. A curved member, typically including a generally spherical wheel, is attached to the mounting member axle, and is able to rotate on the axle. Thus, a finger introduced into this area with downward force will cause the wheel to rotate, thereby directing the finger to roll outward off the wheel and away from the railing. Another embodiment has a mounting member with a unitary, non-rotating curved member. The finger will slide off the curved member and away from the railing.

10 Claims, 4 Drawing Sheets

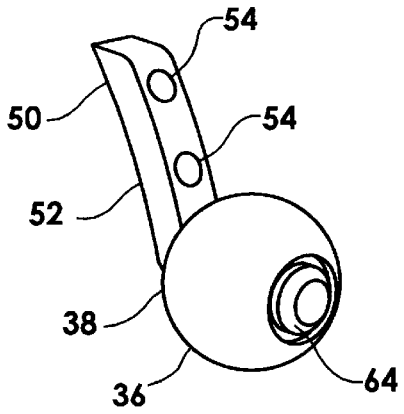
FIG. 3-A
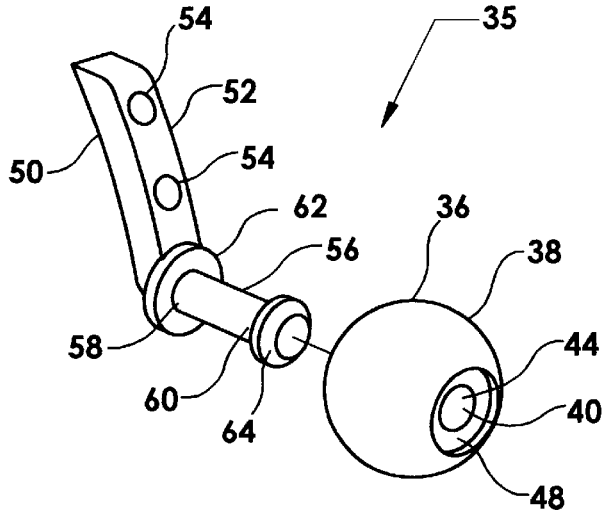
FIG. 3-B
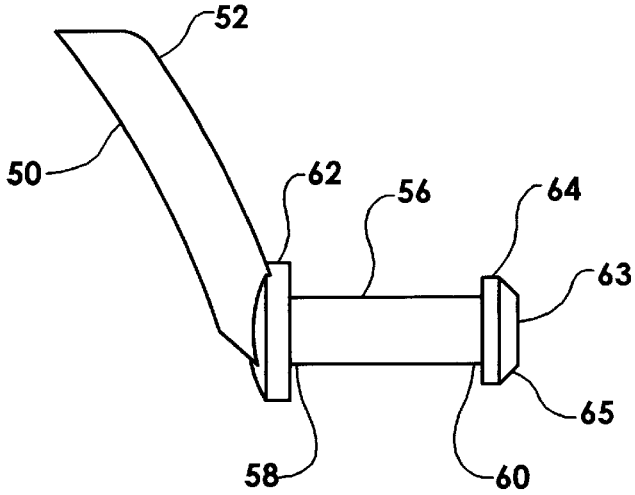
FIG. 4
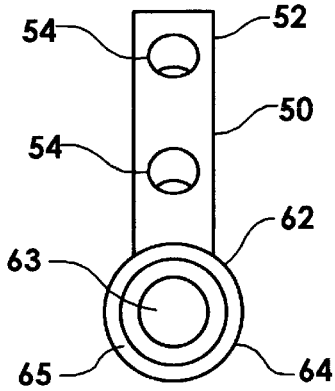
FIG. 5

FINGER PINCH GUARD FOR HANDRAILS

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to the field of safety equipment for handrails, and more particularly to a guard to prevent pinching of a finger between adjacent upright supports of a handrail or fence.

Patio and pontoon boats typically have several railing segments along both sides and across the bow. One railing segment comprises a horizontal handrail between two vertical stanchions. The segment is bent from one piece of metal tubing with arcuate transitions from the handrail to the stanchions. Stanchions of adjacent segments are mounted close together on the boat gunwales. Each pair of adjacent railings forms a generally Y shaped profile in the arcuate transition area. It is at these transition areas where the arcs converge downward that fingers can jam, often with tragic results. Boaters jumping over the handrail into the water have lost fingers in this manner.

Accordingly, there is a need to provide a finger pinch guard for handrails that will prevent a finger from being jammed between the upright stanchions.

There is a further need to provide a finger pinch guard of the type described and that can be installed quickly and easily by a semi-skilled worker.

There is a yet further need to provide a finger pinch guard of the type described and that can be manufactured cost-effectively in large quantities of high quality.

BRIEF SUMMARY OF THE INVENTION

In accordance with the present invention, there is provided a finger pinch guard for use in connection with railings on a boat. Each railing has a horizontal handrail extending between opposite first and second arcuate transitions. Each railing has a first stanchion connected to the first arcuate transition, and a second stanchion connected to the second arcuate transition. Each stanchion extends downward and is mounted to a gunwale of the boat. The railings are mounted in-line along the gunwale of the boat with the stanchion of a first railing being mounted closely adjacent the stanchion of a second railing. Thus, each pair of adjacent stanchions and arcuate transitions forms a generally Y-shaped profile in an arcuate transition area. A mounting member is attached to the railing in the arcuate transition area. A curved member is attached to the mounting member. The curved member curves downward and outward from the arcuate transition area. Thus, a finger introduced into the arcuate transition area with downward force will be directed by the curved member to move outward and away from the railing. The finger is thereby prevented from being pinched in the Y-shaped arcuate transition area.

BRIEF DESCRIPTION OF THE SEVERAL VIEWS OF THE DRAWING

A more complete understanding of the present invention may be obtained from consideration of the following description in conjunction with the drawing, in which:

FIG. 3-A is an assembly view of the finger pinch guard of FIG. 2;

FIG. 3-B is an exploded assembly view of the finger pinch guard of FIG. 2;

FIG. 4 is a front elevational view of a mounting member for the finger pinch guard of FIG. 2;

FIG. 5 is a side elevational view of the mounting member of FIG. 4;

DETAILED DESCRIPTION OF THE INVENTION

Figure 1:
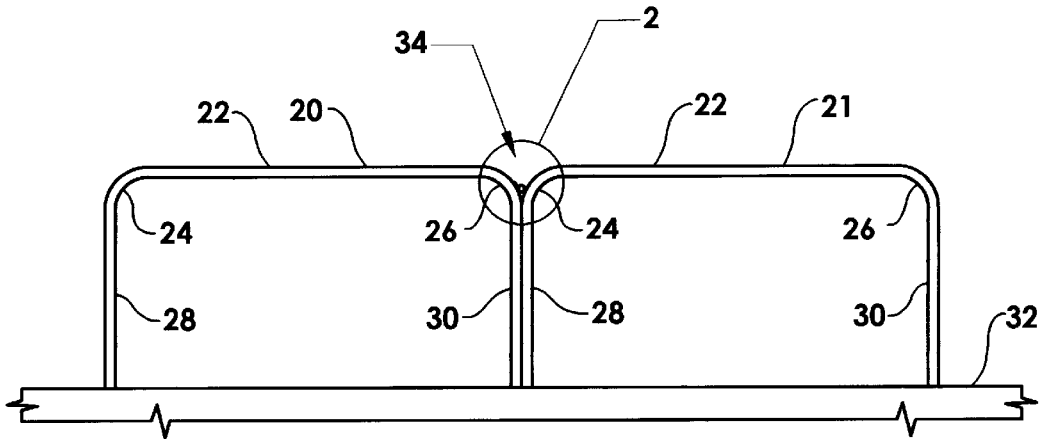
FIG. 1 is a side elevational view of railings mounted in-line on the gunwale of a patio boat, showing the arcuate transition area.

Referring now to the drawing, and especially to FIG. 1 thereof, a finger pinch guard 35 constructed in accordance with the invention is used in connection with railings 20 and 21 on a boat. Each railing 20 and 21 has a horizontal handrail 22 extending between opposite first 24 and second 26 arcuate transitions. Each railing 20 and 21 has a first stanchion 28 connected to the first arcuate transition 24, and a second stanchion 30 connected to the second arcuate transition 26. Each stanchion 28 and 30 extends downward and is mounted to a gunwale 32 of the boat. The railings 20 and 21 are mounted in-line along the gunwale 32 of the boat. The second stanchion 30 of the first railing 20 is mounted closely adjacent the first stanchion 28 of the second rail 21. Each pair of adjacent stanchions 28 and 30 and arcuate transitions 24 and 26 forms a generally Y-shaped profile in an arcuate transition area 34.

Figure 2:
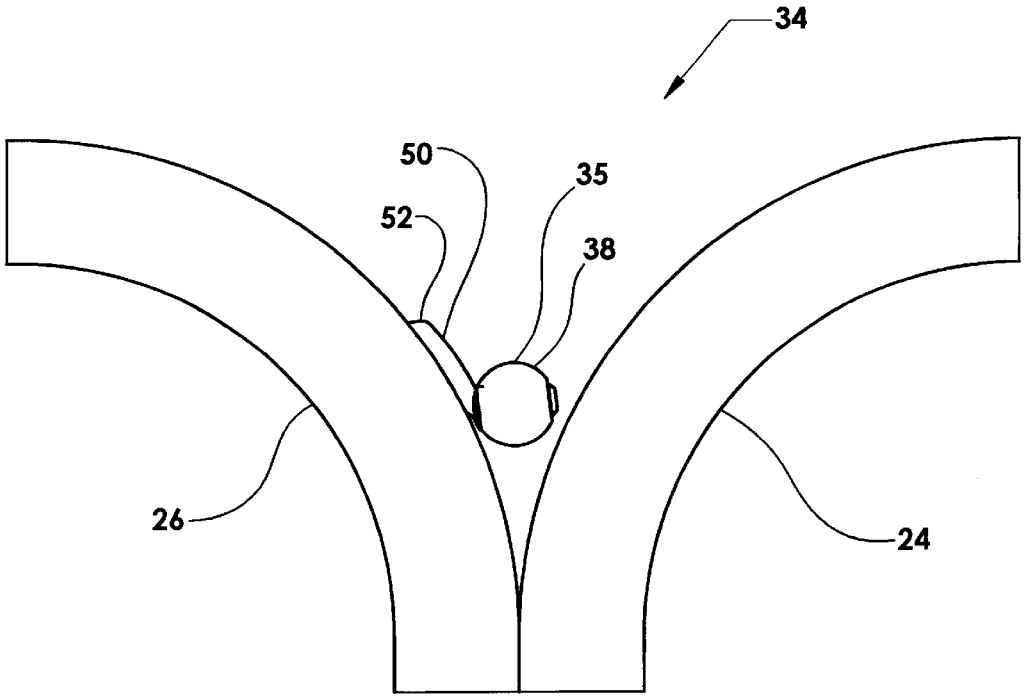
FIG. 2 is a close-up, partial, side elevational view of the arcuate transition area of FIG. 1, showing installation of a finger pinch guard constructed in accordance with the invention.
Figure 6:
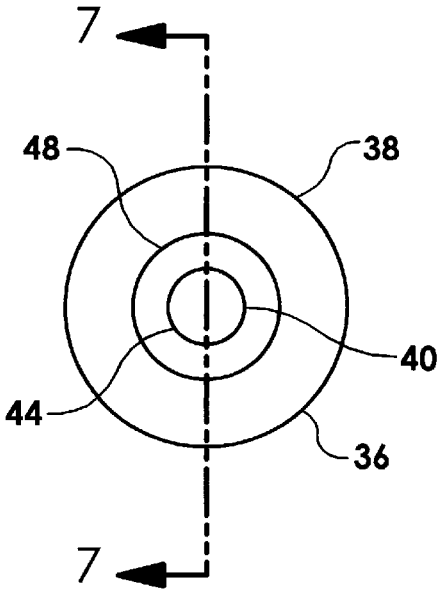
FIG. 6 is a side elevational view of a wheel for the finger pinch guard of FIG. 2.
Figure 7:
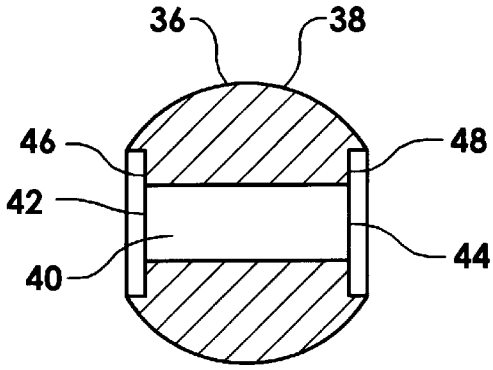
FIG. 7 is a cross-sectional, elevational view of the wheel of FIG. 6 taken along lines 7—7 of FIG. 6.

Turning now to FIGS. 2, 3-A, 3-B, 4, 5, 6, and 7, as well as FIG. 1, the finger pinch guard 35 comprises a curved member 36, which typically includes a generally spherical wheel 38. The wheel 38 is typically about 25 mm (1 inch) in diameter, but can vary from this. The wheel 38 is characteristically molded from an elastomer. A bore 40 extends through the wheel 38 from a first end 42 to a second end 44. The wheel 38 has a first counterbore 46 at the bore first end 42 and a second counterbore 48 at the bore second end 44.

A mounting member 50 is included. The mounting member 50 has a base 52 with at least one, and preferably two mounting holes 54 through the base 52 for attachment to the railing 20 and 21 in the arcuate transition area 34, as shown in FIG. 2. The mounting member 50 has an axle 56 projecting outward at an angle to the base 52. The axle 56 extends between a proximal end 58 connected to the base 52 and an opposite distal end 60. The axle 56 is interposed within the wheel bore 40 so that the wheel 38 is able to rotate on the axle 56. The axle 56 includes a flange 62 at the proximal end 58 interposed within the first counterbore 46. The axle 56 also includes a barb 64 at the distal end 60 interposed within the second counterbore 48. The barb 64 has a distal end 63 with a chamfer 65 for easy assembly. The flange 62 and barb 64 assure smooth rotation and positive retainment of the wheel 38 on the axle 56 by accommodating axial loading. The mounting member 50 is typically molded from a polymer material. Thus, a finger introduced into the arcuate transition area 34 with downward force will cause the wheel 38 to rotate, thereby directing the finger to roll outward off the wheel 38 and away from the railing 20 and 21.

Figure 8:
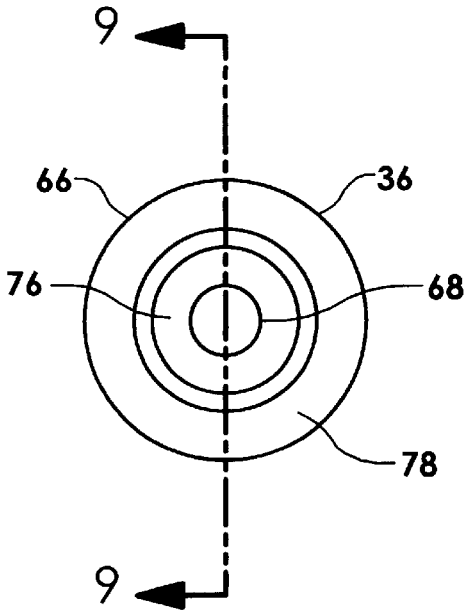
FIG. 8 is a side elevational view of another wheel for the finger pinch guard of FIG. 2.
Figure 9:
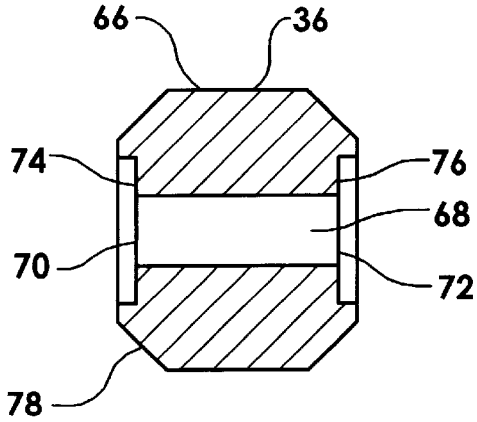
FIG. 9 is a cross-sectional elevational view of the wheel of FIG. 8, taken along lines 9—9 of FIG. 8.

Turning now to FIGS. 8 and 9, another embodiment of the curved member 36, includes a right circular cylindrical wheel 66. A bore 68 extends through the wheel 66 from a first end 70 to a second end 72. The wheel 66 has a first counterbore 74 at the bore first end 70 and a second counterbore 76 at the bore second end 72. The wheel 66 has an annular chamfer 78 each end.

Figure 10:
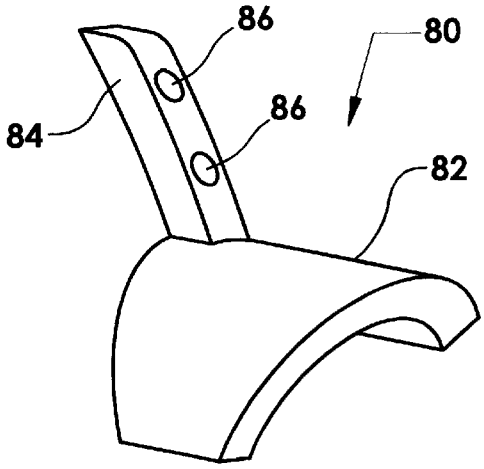
FIG. 10 is a perspective view of another finger pinch guard constructed in accordance with the invention.
Figure 11:
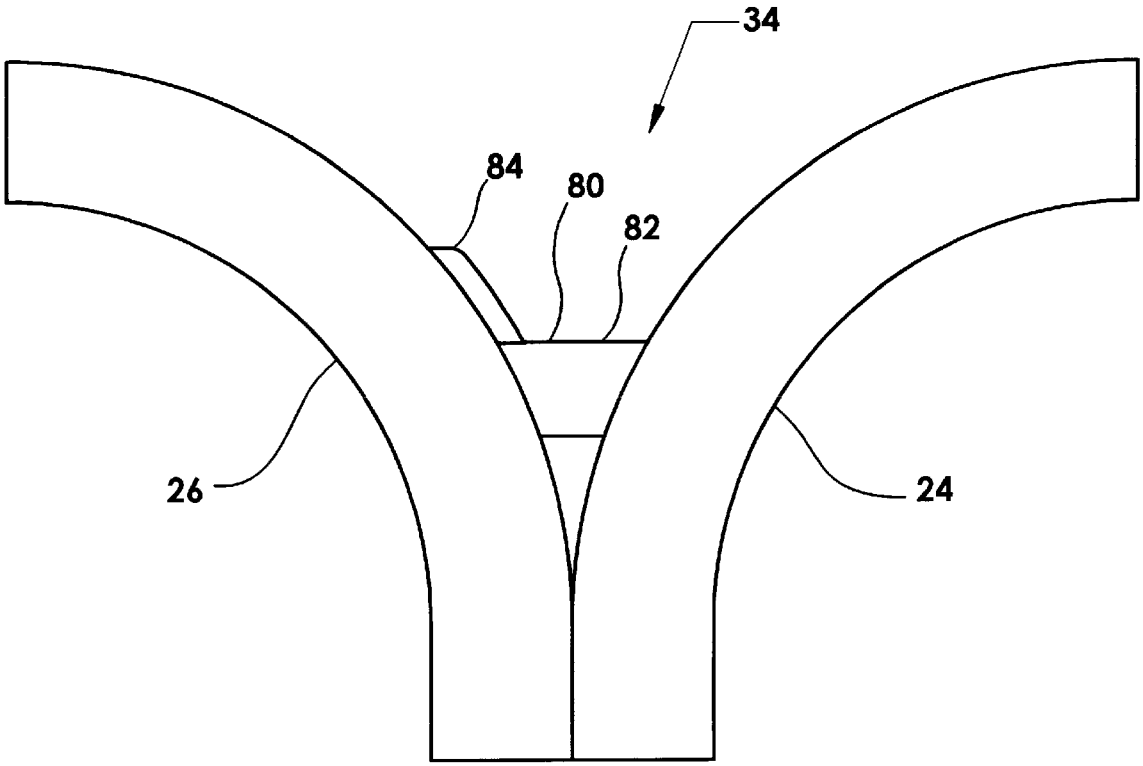
FIG. 11 is a close-up, partial, side elevational view of the arcuate transition area of FIG. 1, showing installation of the finger pinch guard of FIG. 10.

Referring now to FIGS. 10 and 11, another finger pinch guard constructed in accordance with the invention is shown at 80. Pinch guard 80 is similar to pinch guard 35 described above, in that it has a curved member 82 attached to a mounting member 84. The curved member 82 curves downward and outward from the arcuate transition area 34. The mounting member 84 has at least one, and preferably two mounting holes 86 through the mounting member 84 for attachment to the railing 20 and 21 in the arcuate transition area 34. Thus, a finger introduced into the arcuate transition area 34 with downward force will be directed by the curved member 82 to move outward and away from the railing. Pinch guard 80 differs from pinch guard 35, in that curved member 82 is unitary with mounting member 84, both 82 and 84 being formed in one piece. Further, curved member 82 does not rotate, but is fixed in place. The finger will therefore slide outward and away from the railing on the curved member 82. Pinch guard 80 will typically be injection molded from a polymer.

A guarding method is also disclosed for guarding a finger against pinching. The method comprises the steps of attaching a mounting member 50 to the railing 20 and 21 in the arcuate transition area 34, then attaching a curved member 36 to the mounting member 50, then curving the curved member 36 downward and outward from the arcuate transition area 34. Next, introducing a finger into the arcuate transition area 34 with downward force, then directing the finger outward by the curved member 36 and thereby moving the finger away from the railing 20 and 21.

Further steps comprise forming the curved member 36 into a generally spherical wheel 38, then attaching the wheel 38 rotatably to the mounting member 50. Next, introducing a finger into the arcuate transition area 34 with downward force, then causing the wheel 38 to rotate with the downward force, thereby directing the finger outward and rolling the finger off the wheel 38 and away from the railing 20 and 21.

Yet further steps include extending a bore 40 through the wheel 38 from a first end 42 to a second end 44, then forming a first counterbore 46 at the bore first end 42 and a second counterbore 48 at the bore second end 44. Next, providing a base 52 on the mounting member 50, then providing mounting holes 54 through the base 52 for attaching the base 52 to the railing 20 and 21 in the arcuate transition area 34. Next, extending an axle 56 between a proximal end 58 and an opposite distal end 60 and connecting the axle proximal end 58 at an angle to the base 52, then interposing the axle 56 within the wheel bore 40 so that the wheel 38 is able to rotate on the axle 56. Next, providing a flange 62 at the axle proximal end 58 and interposing the flange 62 within the first counterbore 46, then providing a barb 64 at the axle distal end 60 and interposing the barb 64 within the second counterbore 48, for smoothly rotating and positively retaining the wheel 38 on the axle 56. A final step includes forming an annular chamfer 65 around a distal edge 63 of the barb 64 for assembling the wheel 38 onto the axle 56.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

PARTS LIST

Finger Pinch Guard

| PART NO. | DESCRIPTION |
|---|---|
| 20 | railing |
| 21 | railing |
| 22 | handrail |
| 24 | first arcuate transition |
| 26 | second arcuate transition |
| 28 | first stanchion |
| 30 | second stanchion |
| 32 | gunwale |
| 34 | arcuate transition area |
| 35 | finger pinch guard |
| 36 | curved member |
| 38 | spherical wheel |
| 40 | bore |
| 42 | bore first end |
| 44 | bore second end |
| 46 | first counterbore |
| 48 | second counterbore |
| 50 | mounting member |
| 52 | base |
| 54 | mounting holes |
| 56 | axle |
| 58 | proximal end |
| 60 | distal end |
| 62 | flange |
| 63 | distal end |
| 64 | barb |
| 65 | chamfer |
| 66 | cylindrical wheel |
| 68 | bore |
| 70 | bore first end |
| 72 | bore second end |
| 74 | first counterbore |
| 76 | second counterbore |
| 78 | annular chamfer |
| 80 | finger pinch guard |
| 82 | curved member |
| 84 | mounting member |
| 86 | mounting holes |

The embodiments of the invention in which an exclusive property or privilege is claimed are defined as follows:

1. A finger pinch guard for use in connection with railings on a boat, each railing having a horizontal handrail extending between opposite first and second arcuate transitions, each railing having a first stanchion connected to the first arcuate transition, and a second stanchion connected to the second arcuate transition, each stanchion extending downward and being mounted to a gunwale of the boat, the railings being mounted in-line along the gunwale of the boat with the stanchion of a first railing being mounted closely adjacent the stanchion of a second railing, so that each pair of adjacent stanchions and arcuate transitions forms a generally Y-shaped profile in an arcuate transition area, the finger pinch guard comprising:

(a) a mounting member attached to the railing in the arcuate transition area; and (b) a curved member attached to the mounting member, the curved member curving downward and outward from the arcuate transition area, so that a finger introduced into the arcuate transition area with downward force will be directed by the curved member to move outward and away from the railing.

2. The finger pinch guard of claim 1, wherein:

(a) the curved member further comprises a wheel; and (b) the finger pinch guard further comprises rotatable means for rotatable attachment of the wheel to the mounting member, so that a finger introduced into the arcuate transition area with downward force will cause the wheel to rotate, thereby directing the finger to roll outward off the wheel and away from the railing.

3. The finger pinch guard of claim 2, wherein:

(a) the mounting member has a base with at least one mounting hole through the base;

(b) the mounting member has an axle projecting outward at an angle to the base, the axle extending between a proximal end connected to the base and an opposite distal end;

(c) the wheel has a bore; and (d) the rotatable means includes the axle being interposed within the wheel bore so that the wheel is able to rotate on the axle.

4. The finger pinch guard of claim 3, wherein:

(a) the bore extends through the wheel from a first end to a second end;

(b) the wheel includes a first counterbore at the bore first end and a second counterbore at the bore second end; and (c) the axle includes a flange at the proximal end interposed within the first counterbore, and a barb at the distal end interposed within the second counterbore, for smooth rotation and positive retainment of the wheel on the axle, the barb having a distal edge and an annular chamfer around the distal edge to facilitate assembly of the wheel onto the axle.

5. The finger pinch guard of claim 4, wherein the wheel is generally spherical.

6. The finger pinch guard of claim 4, wherein the wheel is a right circular cylinder having an annular chamfer at each end.

7. A finger pinch guard for use in connection with railings on a boat, each railing having a horizontal handrail extending between opposite first and second arcuate transitions, each railing having a first stanchion connected to the first arcuate transition, and a second stanchion connected to the second arcuate transition, each stanchion extending downward and being mounted to a gunwale of the boat, the railings being mounted in-line along the gunwale of the boat with the stanchion of a first railing being mounted closely adjacent the stanchion of a second railing, so that each pair of adjacent stanchions and arcuate transitions forms a generally Y-shaped profile in an arcuate transition area, the finger pinch guard comprising:

(a) a curved member, the curved member including a generally spherical wheel having a bore, the bore extending through the wheel from a first end to a second end, the wheel having a first counterbore at the bore first end and a second counterbore at the bore second end; and (b) a mounting member, the mounting member having a base with at least one mounting hole through the base for attachment to the railing in the arcuate transition area, the mounting member having an axle projecting outward at an angle to the base, the axle extending between a proximal end connected to the base and an opposite distal end, the axle being interposed within the wheel bore so that the wheel is able to rotate on the axle, the axle including a flange at the proximal end interposed within the first counterbore, and a barb at the distal end interposed within the second counterbore, for smooth rotation and positive retainment of the wheel on the axle, so that a finger introduced into the arcuate transition area with downward force will cause the wheel to rotate, thereby directing the finger to roll outward off the wheel and away from the railing.

8. A guarding method for guarding a finger against pinching, for use in connection with railings on a boat, each railing having a horizontal handrail extending between opposite first and second arcuate transitions, each railing having a first stanchion connected to the first arcuate transition, and a second stanchion connected to the second arcuate transition, each stanchion extending downward and being mounted to a gunwale of the boat, the railings being mounted in-line along the gunwale of the boat with the stanchion of a first railing being mounted closely adjacent the stanchion of a second railing, so that each pair of adjacent stanchions and arcuate transitions forms a generally Y-shaped profile in an arcuate transition area, the method comprising the steps of:

(a) attaching a mounting member to the railing in the arcuate transition area;

(b) attaching a curved member to the mounting member;

(c) curving the curved member downward and outward from the arcuate transition area;

(d) introducing a finger into the arcuate transition area with downward force; and (e) directing the finger outward by the curved member and thereby moving the finger away from the railing.

9. The method of claim 8, further comprising the steps of:

(a) forming the curved member into a generally spherical wheel;

(b) attaching the wheel rotatably to the mounting member;

(c) introducing a finger into the arcuate transition area with downward force; and (d) causing the wheel to rotate with the downward force, thereby directing the finger outward and rolling the finger off the wheel and away from the railing.

10. The method of claim 9, further comprising the steps of:

(a) extending a bore through the wheel from a first end to a second end;

(b) forming a first counterbore at the bore first end and a second counterbore at the bore second end;

(c) providing a base on the mounting member;

(d) providing at least one mounting hole through the base for attaching the base to the railing in the arcuate transition area;

(e) extending an axle between a proximal end and an opposite distal end and connecting the axle proximal end at an angle to the base;

(f) interposing the axle within the wheel bore so that the wheel is able to rotate on the axle;

(g) providing a flange at the axle proximal end and interposing the flange within the first counterbore;

(h) providing a barb at the axle distal end and interposing the barb within the second counterbore, for smoothly rotating and positively retaining the wheel on the axle; and (i) forming an annular chamfer around a distal edge of the barb for assembling the wheel onto the axle.

* * * * *